US010033094B2

(12) United States Patent
Lo Hine Tong et al.

(10) Patent No.: US 10,033,094 B2
(45) Date of Patent: Jul. 24, 2018

(54) ANTENNA ASSEMBLY

(71) Applicant: THOMSON LICENSING, Issy de Moulineaux (FR)

(72) Inventors: Dominique Lo Hine Tong, Rennes (FR); Philippe Minard, Saint Medard sur Ille (FR); Jean-Marc Le Foulgoc, Bourgbarre (FR)

(73) Assignee: THOMSON LICENSING, Issy les Moulineaux (FR)

( * ) Notice: Subject to any disclaimer, the term of this patent is extended or adjusted under 35 U.S.C. 154(b) by 427 days.

(21) Appl. No.: 14/520,288

(22) Filed: Oct. 21, 2014

(65) Prior Publication Data

US 2015/0130668 A1 May 14, 2015

(30) Foreign Application Priority Data

Oct. 22, 2013 (FR) ..... 13 60277

(51) Int. Cl.

| | |
|---|---|
| ***H01Q 1/50*** | (2006.01) |
| ***H01Q 1/44*** | (2006.01) |
| ***H01Q 9/42*** | (2006.01) |
| ***H01Q 1/24*** | (2006.01) |

(52) U.S. Cl.

CPC ..... *H01Q 1/50* (2013.01); *H01Q 1/24* (2013.01); *H01Q 1/44* (2013.01); *H01Q 9/42* (2013.01)

(58) Field of Classification Search

CPC .. H01Q 1/50; H01Q 1/24; H01Q 1/44; H01Q 9/42

USPC ..... 343/702, 720

See application file for complete search history.

(56) References Cited

U.S. PATENT DOCUMENTS

| | | | | |
|---|---|---|---|---|
| 6,339,400 | B1 | 1/2002 | Flint et al. | |
| 6,697,022 | B2 | 2/2004 | de Leon et al. | |
| 7,884,769 | B2 | 2/2011 | Boyle | |
| 2004/0227665 | A1* | 11/2004 | Tai | H01Q 1/38 343/700 MS |
| 2010/0164835 | A1* | 7/2010 | Tai | H01Q 1/1207 343/906 |
| 2012/0146817 | A1 | 6/2012 | Tang et al. | |
| 2013/0189936 | A1* | 7/2013 | Li | H01Q 1/44 455/90.2 |

FOREIGN PATENT DOCUMENTS

| | | |
|---|---|---|
| EP | 1505689 | 2/2005 |
| JP | 2006270575 | 10/2006 |
| JP | 4709898 | 3/2011 |
| KR | 20110008871 | 1/2011 |

OTHER PUBLICATIONS

Search Report dated Jun. 26, 2014.

* cited by examiner

*Primary Examiner* — Dameon E Levi
*Assistant Examiner* — David Lotter
(74) *Attorney, Agent, or Firm* — Brian J. Dorini; Patricia A. Verlangieri

(57) ABSTRACT

The present invention relates to an antenna for wireless application made from a component of an electronic device, said component being attached to the casing of the electronic device and comprising a conductive part and at least one mounting pin made of conductive material, the conductive part forming the radiating element of the antenna and the mounting pin being connected electrically to a feed line of the antenna and to a ground plane by a shunt.

12 Claims, 9 Drawing Sheets

ANTENNA ASSEMBLY

This application claims the benefit, under 35 U.S.C. § 119 of French Patent Application No. 1360277, filed Oct. 22, 2013.

TECHNICAL FIELD OF THE INVENTION

The present invention relates to an antenna assembly for wireless applications. One aspect of the invention relates to an antenna made from a component of an electronic device used in a wireless system such as an internet gateways, decoders or other wireless or mobile device. The present invention further relates to a network of antennas and a multiband antenna comprising an antenna in accordance with the present invention.

TECHNOLOGICAL BACKGROUND

Devices used in wireless communication systems of Wi-Fi type such as home networks or increasingly multi-mode and multi-standard devices. In some cases a single wireless device should meet IEEE-802.11 a/b/g/n standards as well as RF4CE, DECT, ZIGBee and Bluetooth standards. Such standards operate in different frequency bands and therefore require several antennas which should be integrated in the same device. This increasing demand for wireless systems compatible with different standards also increases the antenna integration constraints necessary for the operation of these systems, notably due to their number and the crucial lack of space for their integration and their positioning in the casing of the electronic device. Moreover, in such types of electronic device, one or more push-buttons are provided. In general, these push-buttons are mounted on the motherboard or PCB (printed circuit board) of the electronic device. As shown in FIGS. 1(A) and 1(B), a type of push-button used in internet gateways or decoders comprises a frame 1 made of conductive material, more specifically made of metal.

This frame 1 plays the role of supporting a plastic casing 2 which contains the electromechanical control mechanism of the push-button. The metal frame 1 is attached to the motherboard using two pins 3A, 3B made of conductive material, which are inserted into two plated-through holes of the motherboard or PCB 4. The two pins 3A, 3B are in general connected to the ground plane of the PCB 4. As shown more specifically in FIG. 1(B), the casing 2 made of plastic material is also connected to the PCB 4 via two conductive pins, more specifically two metal pins 3C, 3D. Pin 3C is connected to the ground while pin 3D is connected to a line receiving the control signal.

The present invention has been devised with the foregoing in mind.

SUMMARY OF THE INVENTION

A general aspect of the present invention proposes using a component of an electronic device, having another operating function apart from an antenna function to provide an antenna for wireless applications. The component having the other operating function may be a control unit for example.

A first aspect of the invention provides an antenna assembly comprising a first radiating element formed as part of a component of an electronic device having another operating function different to an antenna function, said component comprising a conductive part and an electrically conductive mounting element for mounting the component on a substrate of the electronic device wherein the conductive part forms the first radiating element and the mounting element is electrically connected to a feed line of the antenna and to a ground plane by a shunt. In one or more embodiments the component is a user control unit for controlling operation of the electronic device.

In an embodiment at least one second radiating element is provided on the substrate of the electronic device. In this way the radiating function of the antenna is provided by a plurality of radiating parts. The at least one second radiating element may be adapted according to the wireless application.

In an embodiment, the first radiating element is disposed at a front panel of the housing.

In an embodiment the conductive part forming the first radiating element forms a conductive frame supporting the component.

In an embodiment the component further comprises a second electrically conductive element for mounting the component on the substrate the second electrically conductive element being connected to a line receiving the control signal controlling the operation of the electronic device In an embodiment a third electrically conductive mounting element connected to a ground plane of the substrate, is provided.

In an embodiment a third electrically conductive mounting element connected to an open-circuited transmission line, is provided A second aspect of the invention provides a network of antennas comprising at least two antenna assemblies according to any embodiment of the first aspect of the invention. In an embodiment the at least two antenna assemblies are connected to a common feed line.

A third aspect of the invention provides a dual-band antenna, comprising two antenna assemblies according to any embodiment of the first aspect of the invention. The two antenna assemblies may be connected to a common feed line.

A fourth aspect of the invention provides a user control unit for operating an electronic device, the control unit comprising at least one control element for operating a function of the electronic device;

a conductive support frame for supporting the control element and provided with one or more support connectors for mounting on a substrate of the electronic device;

wherein the conductive support frame forms a first radiating element of an antenna for wireless applications of the electronic device and one of the mounting pins is electrically connected to a feed line to feed the antenna and shunted to ground by means of a shunt line.

In an embodiment at least one second radiating element is provided on the substrate of the electronic device.

In an embodiment, the first radiating element is disposed at a front end of the substrate of the electronic device.

In an embodiment the user control unit further comprises a second electrically conductive element for mounting the control unit on a substrate the second electrically conductive element being connected to a line receiving the control signal controlling the operation of the electronic device In an embodiment a third electrically conductive mounting element connected to a ground plane of the substrate, is provided.

In an embodiment a third electrically conductive mounting element connected to an open-circuited transmission line, is provided.

A fifth aspect of the invention provides an electronic communication device comprising at least one antenna assembly according to any embodiment of the first aspect of the invention, a network of antennas according to any embodiment of the second aspect of the invention or a dual band antenna according to any embodiment of the third aspect of the invention.

A sixth aspect of the invention provides electronic communication device comprising a user control unit for operating the electronic device, the electronic device comprising housing for receiving the electronic communication device;

a substrate for supporting one or more electronic components of the electronic device and a control unit comprising at least one control element for operating a function of the electronic device;

a conductive support frame for supporting the control element and provided with a plurality of metallic mounting pins for mounting on the substrate;

wherein the conductive support frame forms a radiating element of an antenna for wireless applications of the electronic device and one of the mounting pins is electrically connected to a feed line to feed the antenna and shunted to ground by means of a shunt line.

Another aspect of the invention provides an antenna for wireless applications made from a component of an electronic device, said component comprising a conductive part and at least one mounting pin made of conductive material. The conductive part forms the radiating element of the antenna and the mounting pin is connected electrically to a feed line of the antenna and to a ground plane by a shunt.

According to an embodiment, the component is a component comprising a control unit controlling the operation of the electronic device, such as a push-button. The conductive part forming the radiating element is constituted by a conductive frame more specifically a metal frame, supporting the control unit of said component. Moreover, the component comprises at least three mounting pins made of conductive material, a first pin connected electrically to the feed line of the antenna and to a ground plane by a shunt, a second pin connected to a line receiving the control unit controlling the operation of the electronic device and a third pin. This third pin can either be connected to a ground plane or be connected to an open-circuited transmission line whose role is impedance matching at the operating frequency of the antenna.

Further aspects of the present invention provide a network of antennas comprising at least two antennas such as described above connected to a common feed line, this network of antennas being able to be a multi-band antenna such as for example a dual-band antenna. A further aspect of the present invention also provides a communication terminal comprising at least one antenna according to any embodiment of the invention.

BRIEF DESCRIPTION OF THE DRAWINGS

Other characteristics and advantages of the present invention will appear upon reading the description of different embodiments, this description being made with reference to the enclosed drawings, wherein.

DETAILED DESCRIPTION OF THE INVENTION

Figure 2A:
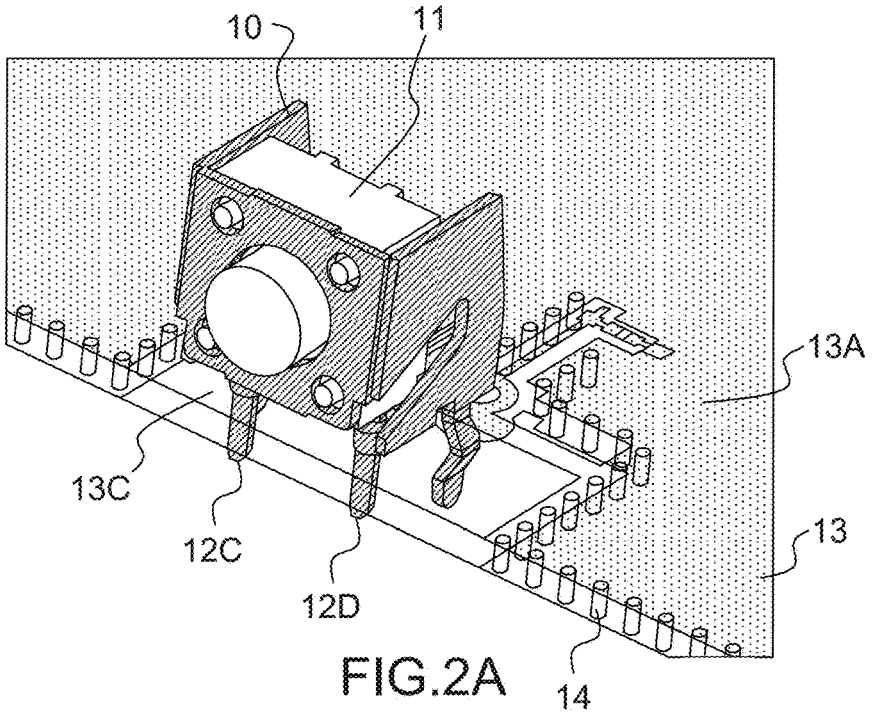
FIGS. 2(A) and (B) show respectively a perspective view and a top view of a push-button forming an antenna in accordance with an embodiment of the present invention.
Figure 2B:
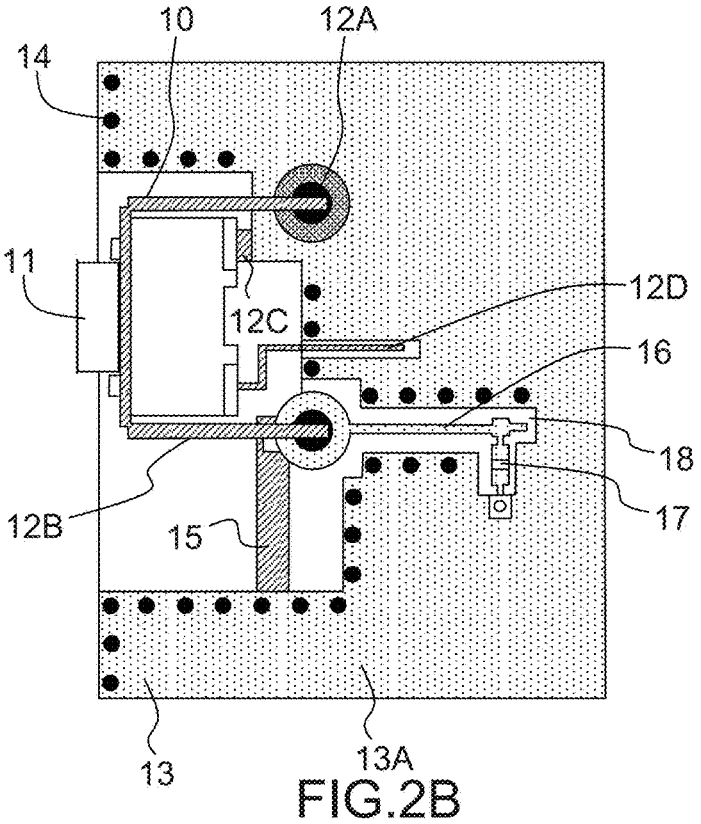
Figure 3:
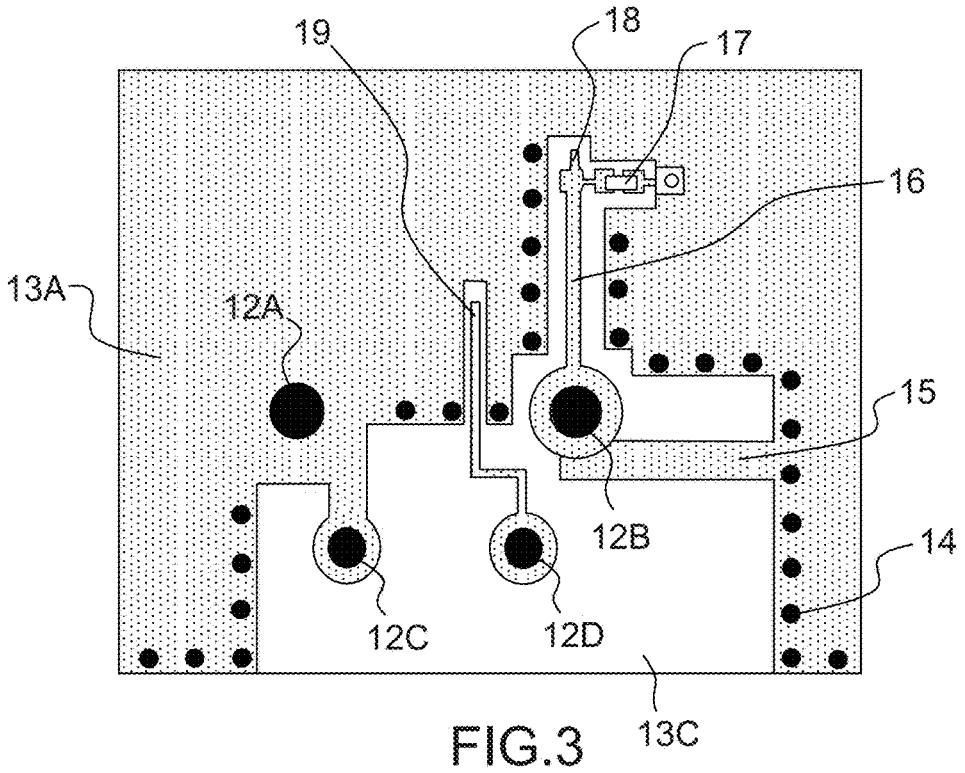
FIG. 3 is a top view of the diagram for mounting, on the motherboard or PCB of an electronic device, the push-button forming the antenna shown in FIG. 2.

A description will first be given, with reference to FIGS. 2 to 8, of a first embodiment of an antenna assembly in accordance with an embodiment of the present invention. As shown more specifically in FIG. 2 (A), the antenna assembly in accordance with the first embodiment is made from a push-button type control unit for an electronic device, such as shown and described with reference to FIG. 1. As shown in FIG. 2 (A), the push-button comprises a frame 10 made of conductive material, for example metal, serving to support a plastic casing 11 housing the electromechanical control mechanism of the push-button. The metal frame 10 forms the first part of the radiating element of the antenna, as explained below. Further parts of the radiating element are provided on the motherboard or PCB. As shown clearly in FIG. 2 (B), the pin 12B extending from the metal frame 10 is connected to a microstrip line 16 etched in the upper layer 13A of the substrate 13 used for the motherboard or PCB of the electronic device. The end 18 of the printed line 16 constitutes the input port of the antenna as shown in FIGS. 2(B) and 3. The length of the line 16 is chosen to provide impedance matching. Moreover, the pin 12B is shunted to the ground by a shunt line 15 connected between the pin 12B and the ground plane 13A. As shown in FIG. 2 (B), the other pin 12A extending the frame 10 made of conductive material is connected directly to the ground plane 13A of the PCB.

Figure 4:
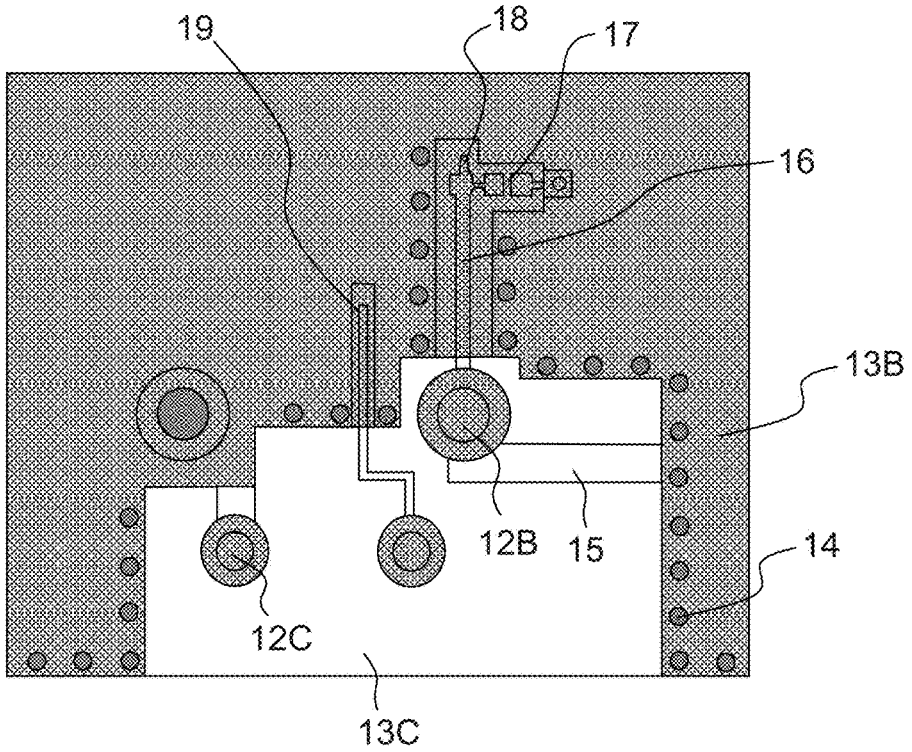
FIG. 4 is a bottom view corresponding to the view of FIG. 3.

The diagram for mounting the push-button on the motherboard or PCB is shown, in a more detailed way, in FIGS. 3 and 4 which are respectively a top and bottom view of said PCB. The shunt line 15 shown in all these figures enables the input impedance matching of the antenna to 50 Ohm and has the result of an efficient radiation of the frame made of conductive material. Moreover, the impedance matching can be carried out at the feed line 16 using an impedance matching component 17 which can be constituted, for example, by an inductor, a capacitor or components formed of inductors and/or capacitors in series or parallel, said component being connected between the feed line 16 and the ground plane 13A.

Pin 12A and shunt line 15 provide further radiating element parts of the antenna. The pin 12A and shunt line 15 act as complementary radiating elements to the frame 10 and can be adapted according to the wireless application to adjust the resonance frequency, as well as providing impedance matching.

Figure 1A:
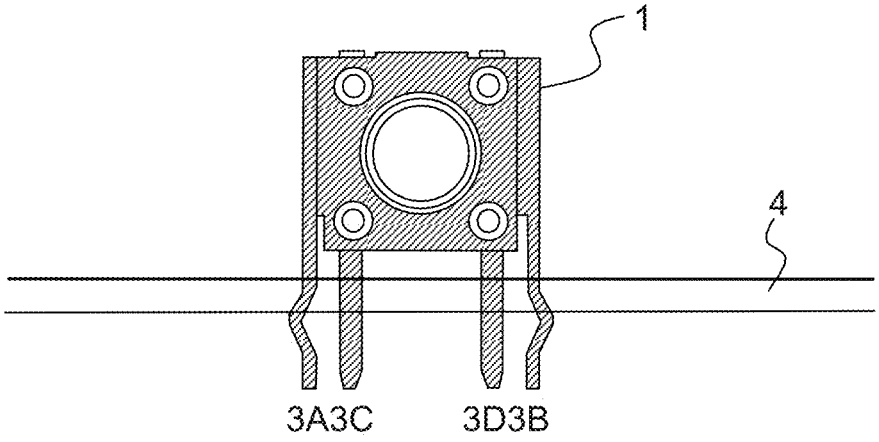
FIGS. 1(A) and (B) already described are respectively a front view and a diagrammatic perspective view of a push-button such as used in the present invention.
Figure 1B:
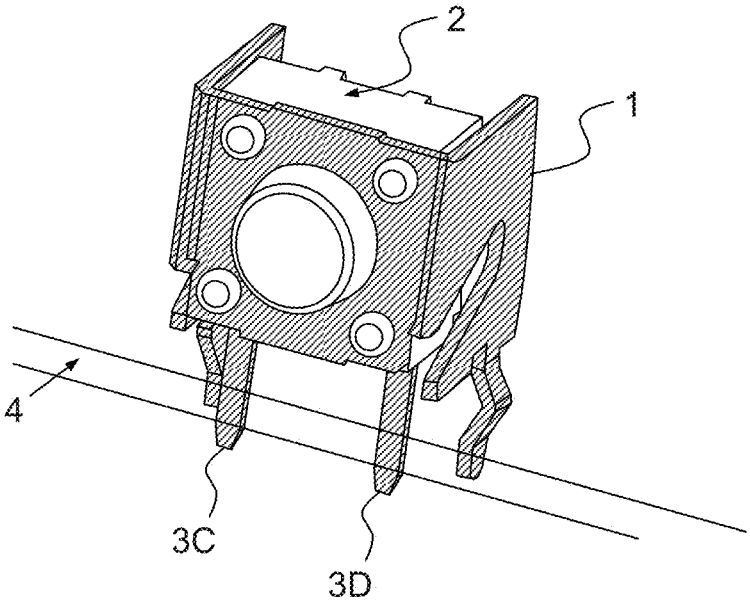

As shown in FIG. 1, the push-button also comprises two metal pins 12C, 12D connected, as in the embodiment of FIG. 1, namely the metal pin 12C is connected to the ground plane 13A and the metal pin 12D is connected to the control line 19 of the push-button. Moreover, the ground planes 13A and 13B of the motherboard are equipped with a window 13C etched respectively in each ground plane in order to mount the push-button in a non-conductive part. They are interconnected by vias 14 making it possible to obtain a common ground. The window is dimensioned so as to optimise the performances of the antenna.

An antenna made as described with reference to FIGS. 2 to 4 was simulated using a 3D electromagnetic simulation tool known under the "HFSS" brand. The substrate used for the motherboard 13 is a low-cost substrate known as FR4. It has a thickness of 1 mm and a surface area of 200*80 mm2.

Figure 5:
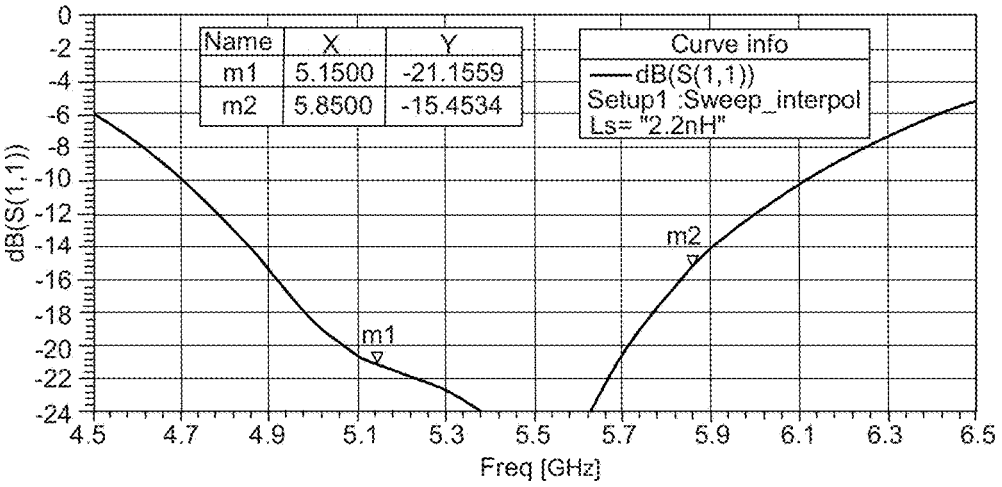
FIGS. 5, 6 and 7 show different curves as a function of the frequency giving the performances of the antenna of FIG. 2.
Figure 6:
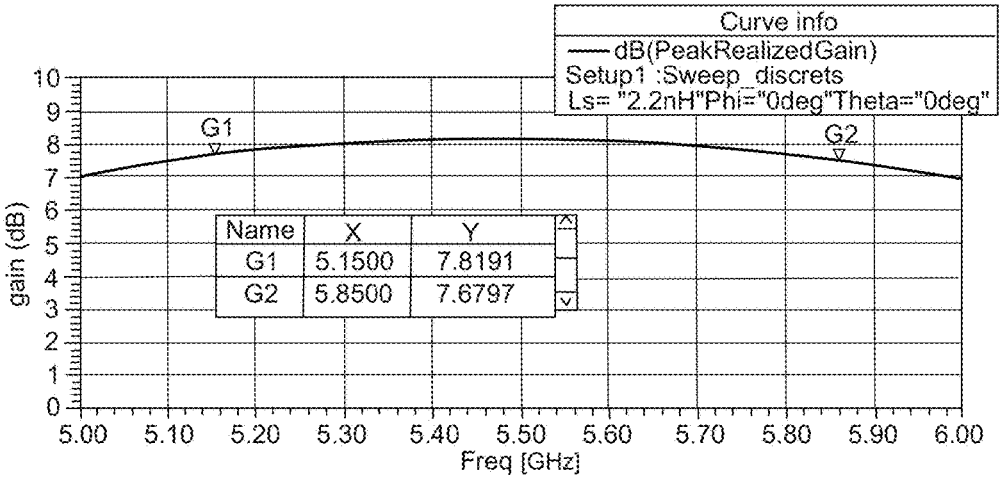
Figure 7:
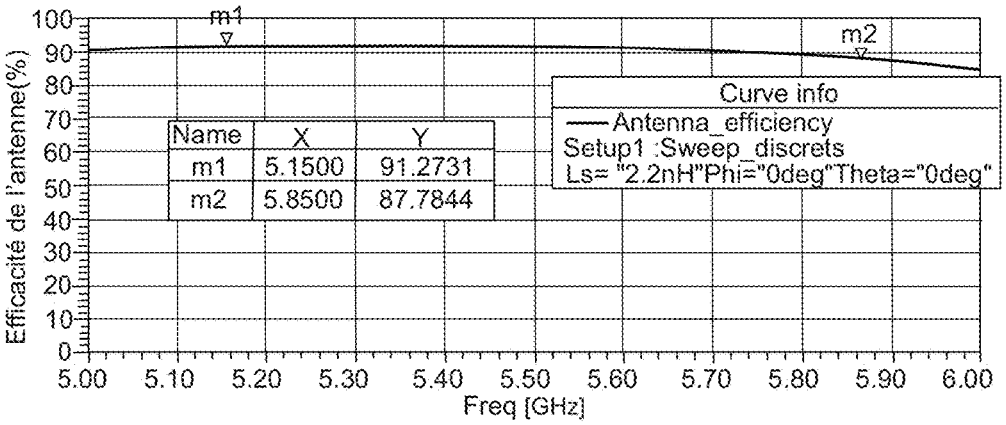
Figure 8:
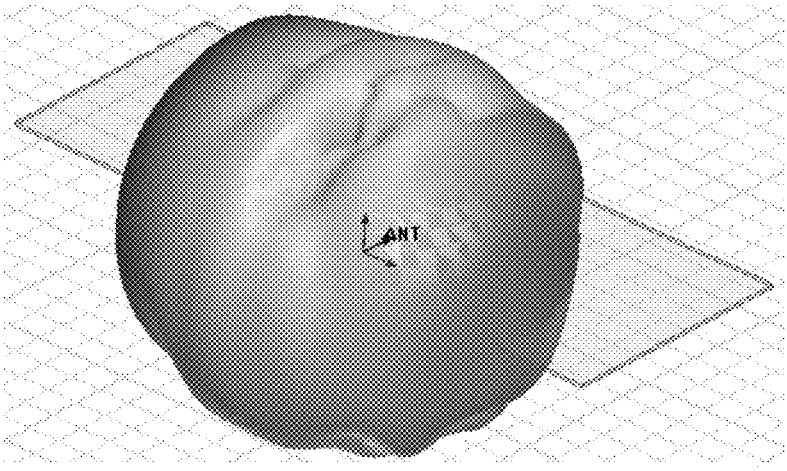
FIG. 8 is a radiation pattern of the antenna of FIG. 2.

The push-button used is a standard push-button having dimensions comprised between 6 and 8 mm for the metal frame forming the radiating surface. Ideally, to obtain an antenna operating directly in the desired frequency band, a half-wavelength resonator is required from point 12A to point 12B. Moreover, the antenna was optimised in terms of impedance matching by using at the input port an impedance matching line 16 and a shunt inductor 17 having a value of 2.2 nH. It is obvious to those skilled in the art that the impedance matching line 16 can be replace with other known impedance matching means such as a self-inductor or a capacitor and that the shunt inductor can be replaced with a transmission line. The choice of the impedance matching means is in fact dictated by size and cost. The antenna thus obtained radiates in the frequency band comprised between 5.15-5.85 GHz of the IEEE-802.11a standard. Thus, in FIG. 5 showing the response as a function of the frequency of the return losses, it can be seen that the antenna is very well impedance matched with a level of return loss less than −15 dB for a range of frequencies around 5.5 GHz. In FIG. 6 which shows the gain as a function of the frequency, a high gain close to 7.5 to 8 dBi is observed. In FIG. 7 which shows the efficiency of the antenna as a function of the frequency, a very high efficiency is observed, close to 90% for the antenna between 5.15 and 5.85 GHz. Moreover, the radiation pattern of FIG. 8 shows that the antenna mainly radiates to the front and at the sides of the motherboard. Thus, the simulations demonstrate that the use of a push-button as described above makes it possible to obtain a very compact antenna, without additional cost, with completely satisfactory performances in terms of return losses, gain, efficiency and radiation pattern.

Another embodiment of an antenna assembly in accordance with the present invention and also using a push-button such as described with reference to FIG. 1 will now be described with reference to FIGS. 9 to 13.

Figure 9A:
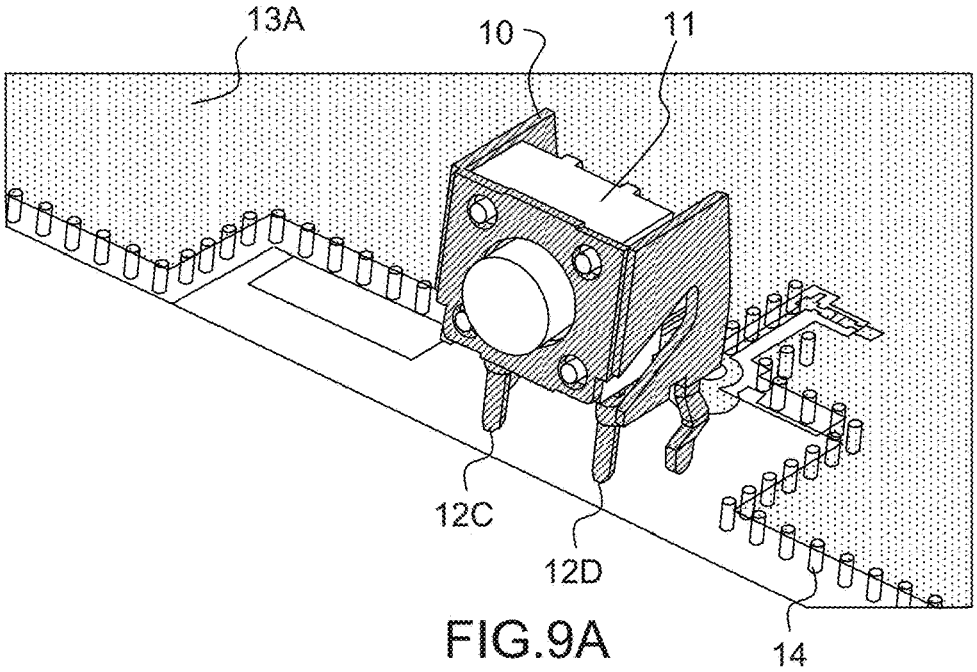
FIGS. 9(A) and (B) show respectively a perspective view and a top view of another embodiment of an antenna in accordance with the present invention.

In this case, to simplify the description of FIGS. 9A and B and 10A and B, the same references have been used for the elements identical to those of FIGS. 2 to 4. In this embodiment, we find the metal frame 10 of the push-button forming the radiating element of the antenna, the plastic casing 11, the pin 12B extending the metal frame and connected by an impedance matching line 16 to the input of the antenna 18, the shunt line 15 making it possible to carry out the impedance matching of the input of the antenna to 50 Ohm and to thus obtain a good efficiency of the radiation of the antenna, and an impedance matching component 17. The metal frame 10 is also extended by another pin 12A made of conductive material and connected to the ground of the PCB 13. Moreover, the metal pins 12C and 12D extending from the plastic casing 11 are connected for the pin 12D to the line 19 of the control signal of the push-button and for the pin 12C to the ground plane 13A, as shown in the different FIGS. 9 and 10.

In accordance with this embodiment, the pin 12A is extended by an open-circuited transmission line 20 whose purpose is to optimise the operating frequency of the antenna and the level of the return losses. This line has a length approximately equal to a quarter of the wavelength at the central frequency of the operating band of the antenna, the purpose being to provide a short-circuit at point 12A. Shunt line 15 and transmission line 20 associated with the metal frame constitute further radiating elements and contribute to the results of the antenna performances in terms of gain, efficiency and radiation pattern. The transmission line 20 and shunt line 15 act as complementary radiating elements to the frame 10 and can be adapted according to the wireless application to adjust the resonance frequency, as well as providing impedance matching.

Figure 9B:
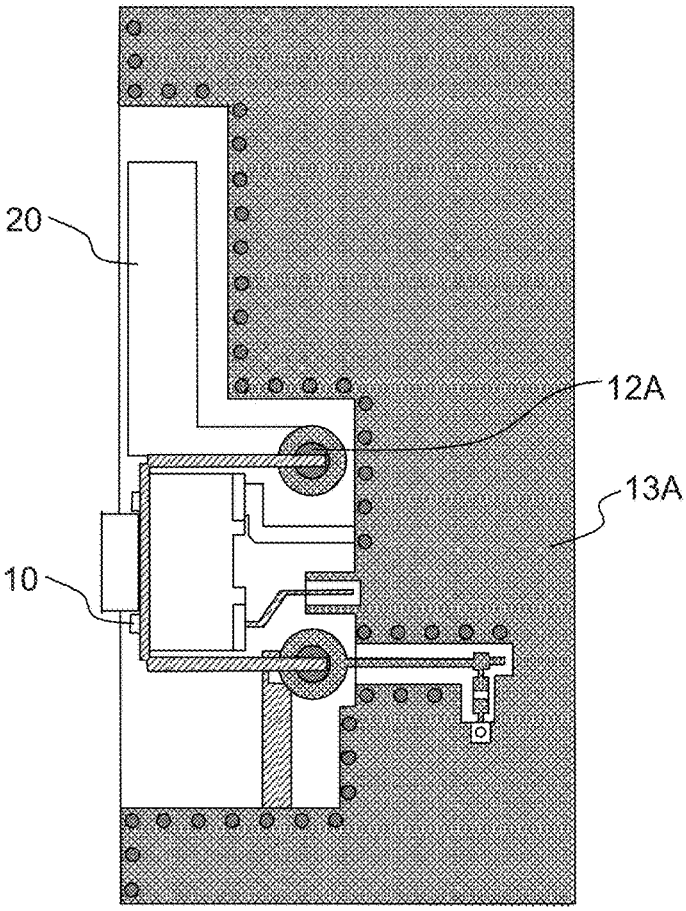
Figure 10A:
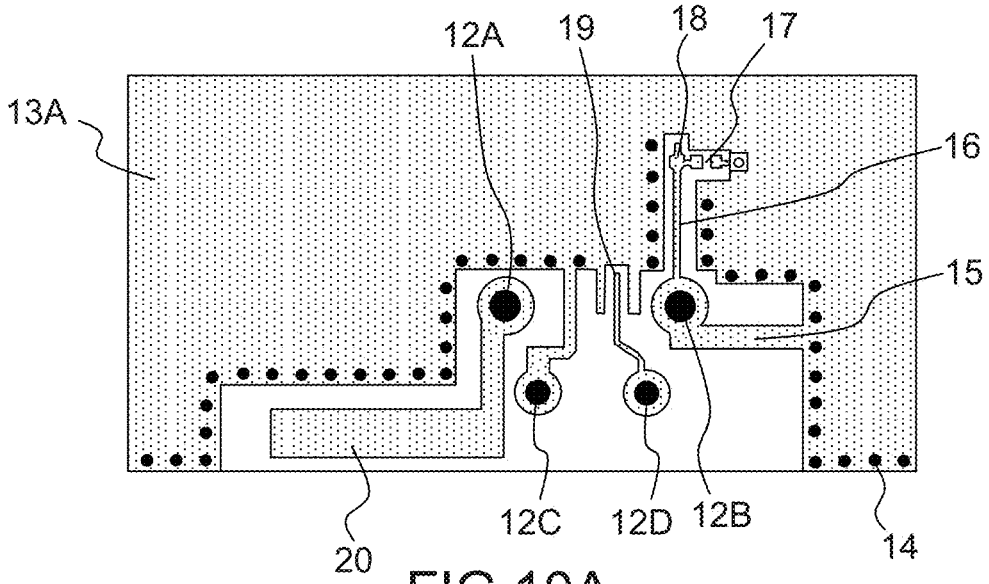
FIGS. 10(A) and (B) show respectively a top view and a bottom view of the diagram for mounting on the motherboard the antenna in accordance with FIGS. 9(A) and (B).
Figure 10B:
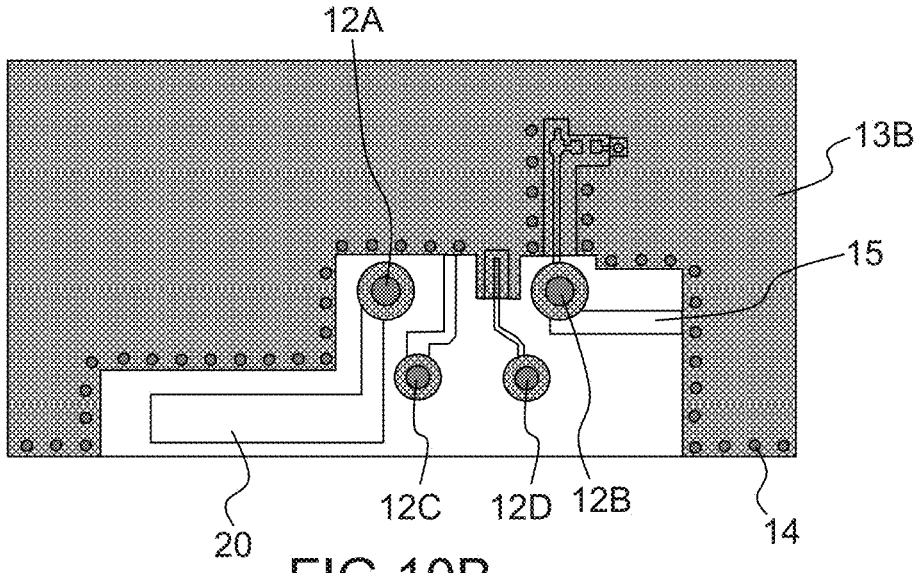
Figure 11:
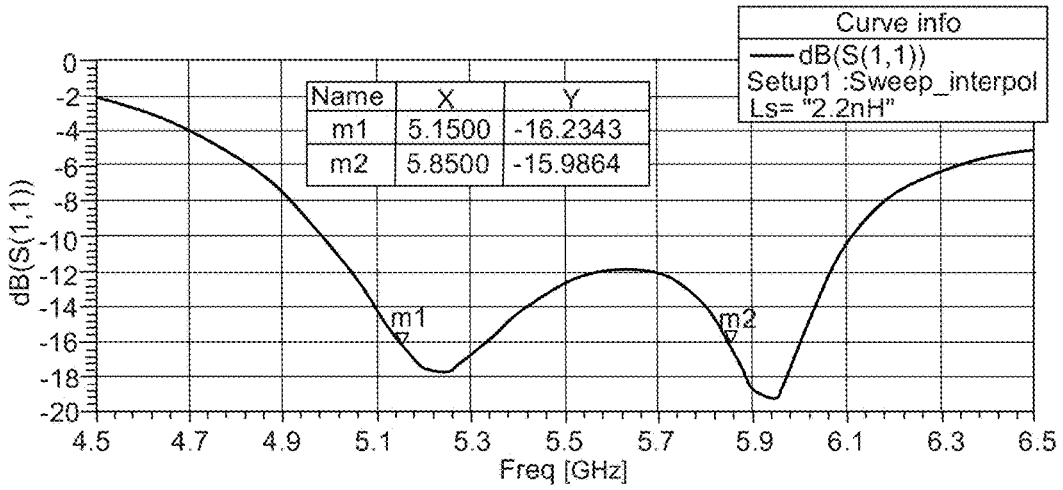
FIGS. 11, 12 and 13 respectively show as a function of the frequency different curves giving the performances of the antenna of FIG. 9, and FIG. 14A to C are perspective view illustrating a PCB board and an electronic device in accordance with embodiments of the invention.
Figure 12:
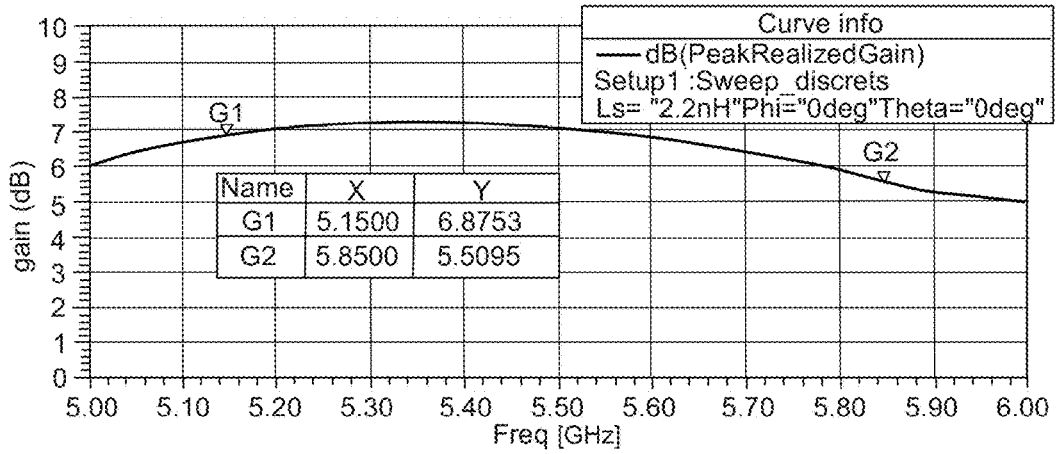
Figure 13:
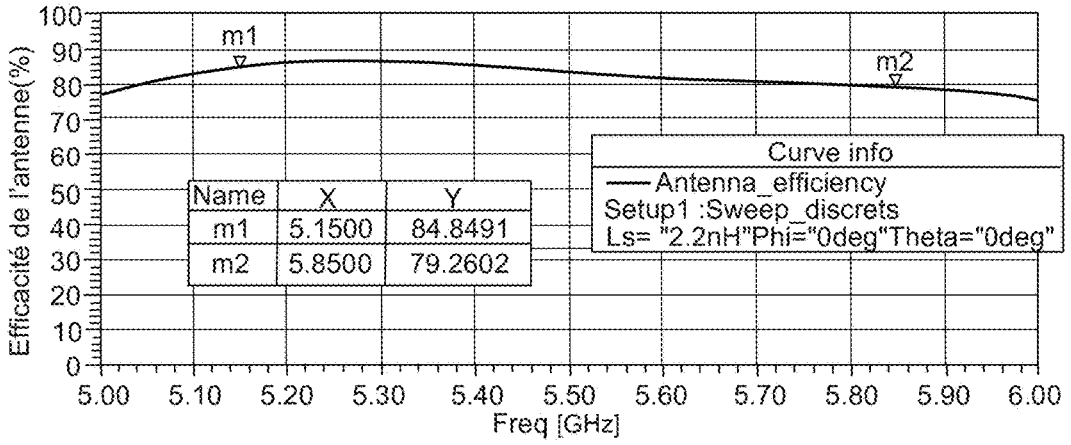

An antenna such as shown in FIGS. 9 and 10 was simulated using the same simulation tool as that used for the antenna of FIGS. 2 to 8 as well as the same push-button and the same type of substrate. FIG. 11 shows the return losses as a function of the frequency and shows a level of return loss less than −12 dB. FIG. 12 shows the gain as a function of the frequency and shows a level of gain slightly less than that obtained for the embodiment of FIGS. 2 to 8 but nevertheless greater than 5.5 dBi. FIG. 13 shows the efficiency of the antenna as a function of the frequency and this efficiency remains at a high level greater than 80%.

The simulations carried out on the antenna constituted from a push-button show that performances in terms of return loss, gain, efficiency and radiation pattern are obtained which are comparable to a low-cost metal antenna obtained by stamping and mounted on the PCB.

Figure 14A:
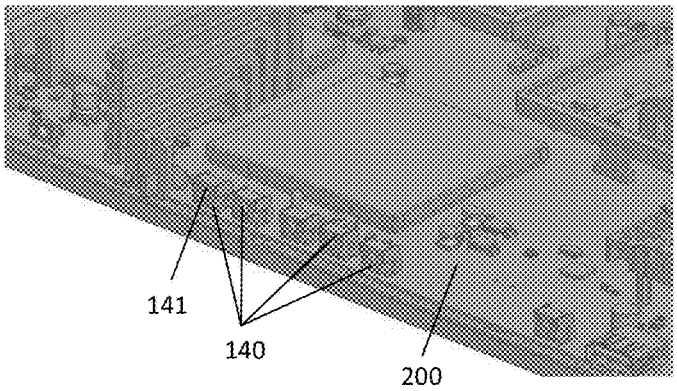

FIG. 14A is a perspective view of a plurality of control units 140 in accordance with embodiments of the invention mounted at the front end of PCB board 200 of a wireless electronic device 300. In this embodiment the control units 140 are push button type control units. A push button 140 provides the operating function of a control unit for controlling operating of the electronic device 300 and an antenna. The metallic frame 141 of each push button 140 operates as the radiating element of the antenna function. Further radiating elements are printed on the PCB board 200. In this way a push button provides a dual function—a control unit and an antenna.

Figure 14B:
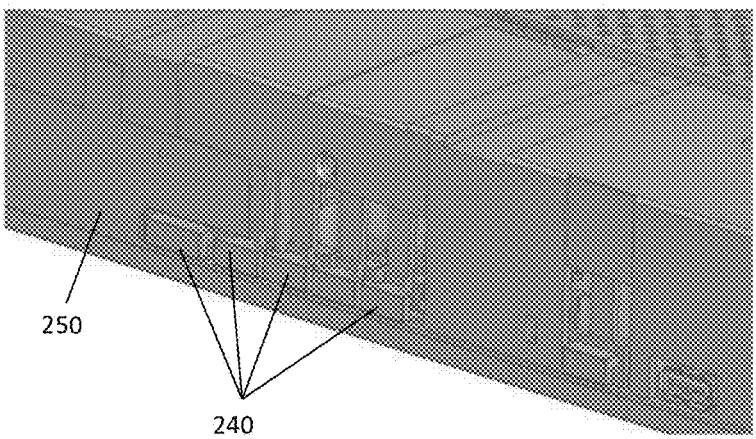
Figure 14C:
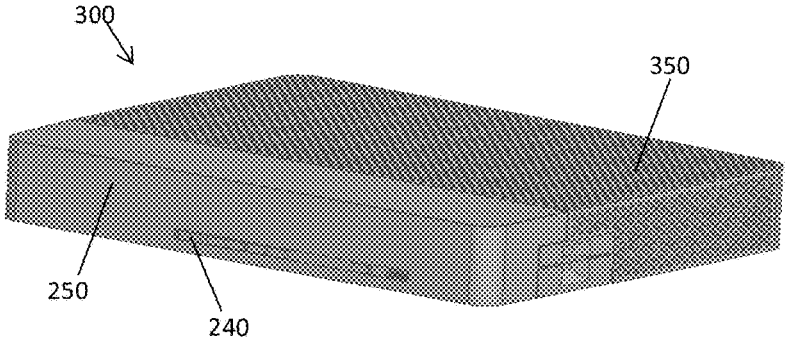

FIG. 14B is a perspective view of the electronic device of FIG. 14A with the front panel 250 in place. User buttons 240 operatively connected to control units 140 enable the control units to be operated from the exterior of the electronic device 300 by a user. FIG. 14C is a full perspective view of the wireless electronic device 300 showing the housing 350 of the electronic device.

Embodiments of the present invention can be applied to all types of components containing a metal surface of right angle shape or not and which comprises at least one or more pins made of conductive material which are originally connected to the ground. The antenna described above can be part of a network of antennas connected to a common feed line using a series of aligned push-buttons, each forming a radiating element. The network can be formed of antennas fed in series or in parallel. If two successive push-buttons are used, each with appropriate complementary radiating elements printed on the PCB, it is possible to obtain a dual-band antenna operating in the band of frequencies around 2.4 GHz and around 5 GHz, the two push-buttons being fed by a common line.

Embodiments of the present invention makes it possible to integrate easily and at low cost an antenna in a wireless communication terminal such as an internet gateway, a decoder, a tablet or other mobile electronic device.

The invention claimed is:

1. An antenna assembly comprising a first radiating element formed as part of a component of an electronic device, said component comprising a conductive part and an electrically conductive mounting element for mounting the component on a substrate of the electronic device, wherein the conductive part forms the first radiating element and the mounting element is electrically connected to a feed line of the antenna and to a ground plane by a shunt line, the component having another operating function of the electronic device in addition to an antenna function, wherein the shunt line is provided on the substrate and operates as a second radiating element and wherein the shunt line is adapted to adjust the resonance frequency and provide impedance matching for the first radiating element.

2. An antenna assembly according claim 1, wherein the component is a user control unit for controlling the operation of the electronic device.

3. An antenna assembly according to claim 1 wherein a transmission line is a further radiating element.

4. An antenna assembly according to claim 1, wherein the conductive part forming the first radiating element forms a conductive frame supporting the component.

5. An antenna assembly according to claim 2, wherein the component further comprises a second electrically conductive mounting element connected to a line receiving the control signal controlling the operation of the electronic device.

6. Antenna assembly according to claim 1 further comprising a third electrically conductive mounting element connected to a ground plane of the substrate.

7. Antenna assembly according to claim 1 further comprising a third electrically conductive mounting element connected to an open-circuited transmission line.

8. A network of antennas comprising at least two antenna assemblies according to claim 1.

9. A dual-band antenna, comprising two antenna assemblies according to claim 1.

10. A user control unit for operating an electronic device, the user control unit comprising an antenna assembly having a first radiating element formed as part of a component of an electronic device, said component comprising a conductive part and an electrically conductive mounting element for mounting the component on a substrate of the electronic device, wherein the conductive part forms the first radiating element and the mounting element is electrically connected to a feed line of the antenna and to a ground plane by a shunt line, the component having another operating function of the electronic device in addition to an antenna function, wherein the shunt line is provided on the substrate and operates as a second radiating element and wherein the shunt line is adapted to adjust the resonance frequency and provide impedance matching for the first radiating element: wherein the component is a control element for operating a function of the electronic device and the conductive part is a conductive support frame for supporting the control element.

11. An electronic communication device comprising at least one antenna assembly according to claim 1.

12. An electronic communication device comprising a user control unit for operating the electronic device, the electronic device comprising housing for receiving the electronic communication device; a substrate for supporting one or more electronic components of the electronic device; and the user control unit comprising at least one control element for operating a function of the electronic device; a conductive support frame for supporting the control element and provided with a plurality of mounting elements for mounting on the substrate; wherein the conductive support frame forms a first radiating element of an antenna for wireless applications of the electronic device and one of the mounting elements is electrically connected to a feed line to feed the antenna and shunted to ground by means of a shunt line, wherein the shunt line is provided on the substrate and operates as a second radiating element and wherein the shunt line is adapted to adjust the resonance frequency and provide impedance matching for the first radiating element.

* * * * *